US005833082A

United States Patent [19]

Barthel

[11] Patent Number: 5,833,082

[45] Date of Patent: Nov. 10, 1998

[54] DOCUMENT DISPLAY STAND WITH PIVOTING POCKETS

[75] Inventor: Jean-Marc Barthel, Strasbourg, France

[73] Assignee: Tarifold, S.A., Illkirch, France

[21] Appl. No.: 682,549

[22] PCT Filed: Nov. 17, 1995

[86] PCT No.: PCT/FR95/01513

§ 371 Date: Jul. 22, 1996

§ 102(e) Date: Jul. 22, 1996

[87] PCT Pub. No.: WO96/15911

PCT Pub. Date: May 30, 1996

[30] Foreign Application Priority Data

Nov. 24, 1994 [FR] France ..... 94 14325

[51] Int. Cl.[6] ..... B42D 1/00

[52] U.S. Cl. ..... 211/47; 281/21.1; 211/169; 40/376; 40/405; 402/79

[58] Field of Search ..... 211/47, 96, 169, 211/48; 402/79; 312/233, 183; 281/21.1, 36; 40/376, 390, 403, 405; 248/441.1, 444.1, 458, 460

[56] References Cited

U.S. PATENT DOCUMENTS

| | | | |
|---|---|---|---|
| 1,616,897 | 2/1927 | Hayes | 40/403 X |
| 2,558,996 | 7/1951 | Ullmann | 281/21.1 X |
| 3,302,318 | 2/1967 | Lewis | 40/403 |
| 3,391,796 | 7/1968 | Cross | 211/169 |
| 3,412,868 | 11/1968 | Carter | 40/403 X |
| 3,446,360 | 5/1969 | Gutierrez | 211/169 X |
| 3,514,883 | 6/1970 | Albright | 211/169 X |
| 3,570,071 | 3/1971 | Wardell | 281/21.1 X |
| 3,913,995 | 10/1975 | Malcik et al. | 312/183 |
| 4,102,069 | 7/1978 | Eckert | 211/169 X |
| 4,270,290 | 6/1981 | Eckert | 211/169 X |
| 4,426,007 | 1/1984 | Beleckis et al. | 40/211 |
| 4,516,871 | 5/1985 | Leitman | 402/79 |
| 4,907,904 | 3/1990 | Baldwin | 281/21.1 X |
| 4,934,738 | 6/1990 | Colonna | 281/21.1 X |
| 5,040,216 | 8/1991 | Policht | 402/79 X |
| 5,104,147 | 4/1992 | King | 281/21.1 |
| 5,183,296 | 2/1993 | Policht | 281/21.1 X |
| 5,186,496 | 2/1993 | Seki | 402/79 X |
| 5,431,449 | 7/1995 | Arimoto et al. | 402/79 X |
| 5,476,336 | 12/1995 | Osiecki et al. | 402/79 |
| 5,551,577 | 9/1996 | Hagopian | 211/96 X |

FOREIGN PATENT DOCUMENTS

| | | |
|---|---|---|
| 0438034 | 7/1991 | European Pat. Off. . |
| 168460 | 6/1934 | Switzerland . |
| 1 532 005 | 11/1978 | United Kingdom . |

*Primary Examiner*—Leslie A. Braun
*Assistant Examiner*—Stephen S. Wentsler
*Attorney, Agent, or Firm*—Davis and Bujold

[57] ABSTRACT

The present invention concerns a document display stand with pockets used to store documents. A connecting device is used to mount each of the pockets on a holder. The connecting device has a guiding device with a beak to prevent the pockets from being mounted to the holder in an upside-down manner. The display stand is modular, flexible and multipurpose, and can accommodate a variety of pocket formats.

12 Claims, 4 Drawing Sheets

DOCUMENT DISPLAY STAND WITH PIVOTING POCKETS

Figure 1:
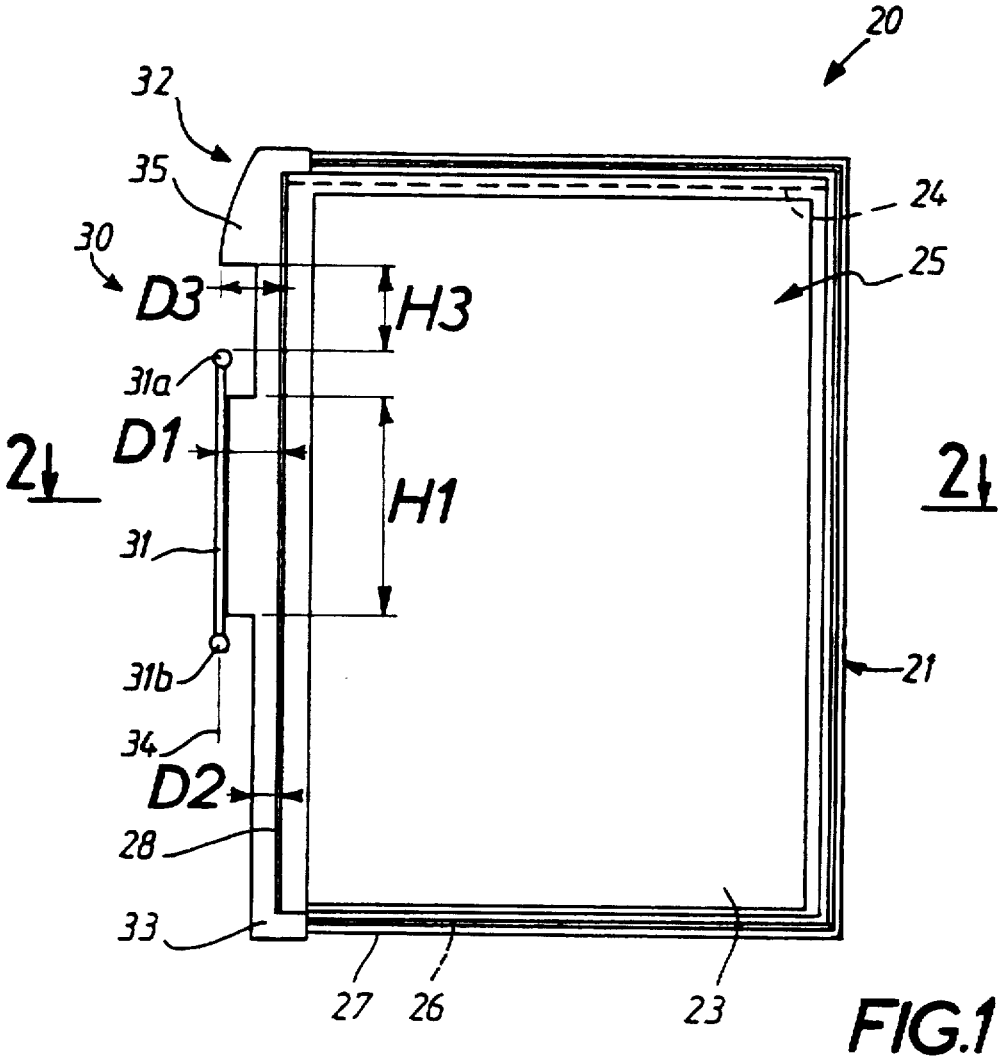

The present invention relates to a document display stand comprising at least one row of pockets provided with transparent envelopes designed to contain said documents, a holder designed to support said pockets and a movable connecting device designed to fix said pockets on said holder so that these pockets can pivot around an axis which is substantially parallel to one of their sides similar to the pages of a book, said connecting device having a connecting member located along one side of each pocket, and receiving means located on a front face of the holder designed to support said connecting members of said row of pocket's holder in a pivoting and movable manner, each of said connecting members having projections which define a pivot axis parallel to said side of the pocket and located at a distance from said envelope, and the receiving means comprising at least one row of recesses in which said projections are inserted by an axial movement parallel to the pivot axis, said projections having a pivot rod located parallel to said side of the pocket, the connecting member having a holding strip between this rod and the envelope, and the receiving means having at least one groove for each pocket designed to receive the pocket's pivot rod.

It is widely known that one of the best solutions for properly displaying information contained on documents such as sheets of paper, cardboard or any man-made material is to use a display stand like the one described above which makes it possible to protect said documents against dirt whilst being easy to read and the information sought readily accessible. There are several types of display stands depending on the place where this information is to be found, for example, the "desk" type to be laid on a work surface, "wall" or "rotating" type, in the latter case, the display stand is circular instead of being flat. We know of transparent pockets which are made rigid on their periphery by means of a metal or synthetic wire and have attached pivots extending from the ends of one of their sides firmly connected to said pocket by crimping or welding, this side defining the pivot axis of the pocket on their holder. The desk or wall type holder are generally made up of a simple metal plate supported by a back stand or fixed to the wall whose upper and lower edges are bent forward at a right angle. These bent edges each have a row of crossing recesses designed to accomodate the corresponding pivots of said pockets. Known holders are designed to receive a precise number of transparent pockets and can not be assembled together to increase this number. They are therefore not modular. Furthermore, to insert or withdraw a pocket from a holder, the user has to use both hands in order to slightly deform the corresponding pocket so as to insert or remove the pivots from the holder's said recesses. What is more, when putting the pockets in place on a holder, it is easy to position them upside-down as no guiding device is provided. Depending on the dimensions of the documents to be protected and displayed, there are several transparent pocket formats, for example for the A5, A4, A3 document formats (European formats) and the American U.S. format. As the length of said pocket's pivot axis is different for each format, it is then necessary to provide a holder adapted to the corresponding format. There are therefore as many different holders as there are transparent pocket formats. These holders are very basic, as described previously, which makes them easy to manufacture by any third party, thus penalising designers and distributors specialising in organisation equipment. It is also important to point out that these holders have to be completed with lateral stops allowing the documents to be held on the right or left of the holder. These stops usually come in the shape of a rod the edges of which are curved to be able to be mounted in corresponding notches provided on the holder. They are easy to move and can therefore be removed or lost quickly, thus hampering the use of the display stand.

The American publication U.S. Pat. No. 4,426,007 describes a storage device for floppy disks using several pockets designed to receive said disks and be mounted in a movable manner in a holder. Each pocket is borne by a connecting member along one of its edges and provided with a pivot rod. The holder has several parallel grooves designed to receive said pivot rod in a pivoting manner. Each groove has a relatively flexible holding element making it possible to slot the pivot rod into said groove. In this device, in order to put a pocket in place in the holder, one of the ends of the rod has to be inserted into an upper hole in said holder, and the rod then forced into the groove. Furthermore, the pocket can be mounted in both directions.

The European publication EP-A-0438034 describes an album the pages of which can be removed. Each page is provided with a connecting member fitted with a pivot rod. The back of the album is provided on its upper and lower end with two rows of aligned and opposite recesses, designed to receive the ends of said rod. One of the row of recesses can have a removable cover to make it easy to put the pages in place.

As in the device described in the American publication, the operations required to put a page in place and remove it are not instantaneous and no guiding device has been provided.

The object of the present invention is to overcome the above-mentioned drawbacks by offering a display stand the design of which has been the subject of a more in-depth study, particularly in terms of the shape of the various constituent parts, so that said display stand is easy to modulate in order to increase the number of pockets per holder, flexible to receive several formats of pockets, multipurpose to be used both in a desk and wall-mounted version, simple to handle and preferably able to be fitted with guiding means to avoid putting the pockets upside-down on their holder.

These objects are achieved by a display stand such as defined in the introduction, characterised in that the connecting device offers the advantage of having an guiding device designed to prevent a pocket from being mounted upside-down on the holder, this device having respective parts, on the holder and on the connecting member of each pocket, designed to bump against each other to prevent said projections from being inserted in the receiving means, or prevent the connecting member from pivoting when the pocket is positioned upside-down.

In a preferred form of embodiment, the receiving means have at least one front opening, in the vicinity of said recesses, making it possible to insert said projections in the recesses first by a movement perpendicular to the pivot axis, and then by said axial movement.

The pivot rod offers the advantage of having at least one protruding free end which is thicker to form an indexing head.

The guiding device preferably has a dissymetric configuration of the holding strip and can have a beak provided on this strip.

The receiving means offer the advantage of having at least one opening for insertion purposes which extends from the groove and is wider than the groove to allow the pivot rod's indexing head to pass during said perpendicular movement. The grooves can be delimited laterally by guide elements which extend in front of the recesses designed to receive said indexing heads.

The front face of the holder can laterally have at least one pair of prominent stops, incorporated into said holder and designed to limit the pivoting of said pockets.

According to the preferred form of embodiment, the holder has movable coupling means on its sides, designed to assemble several holders together.

These movable coupling means offer the advantage of having a male part on one of the lateral faces and a complementary female part on the other lateral face, these coupling means also having snap-on means.

Figure 2:
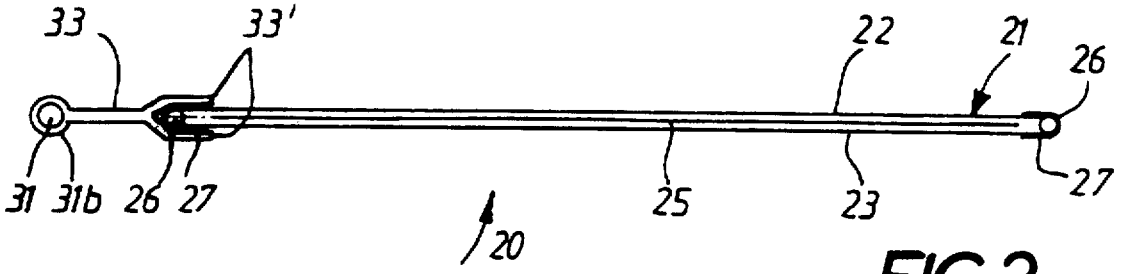
Figure 3:
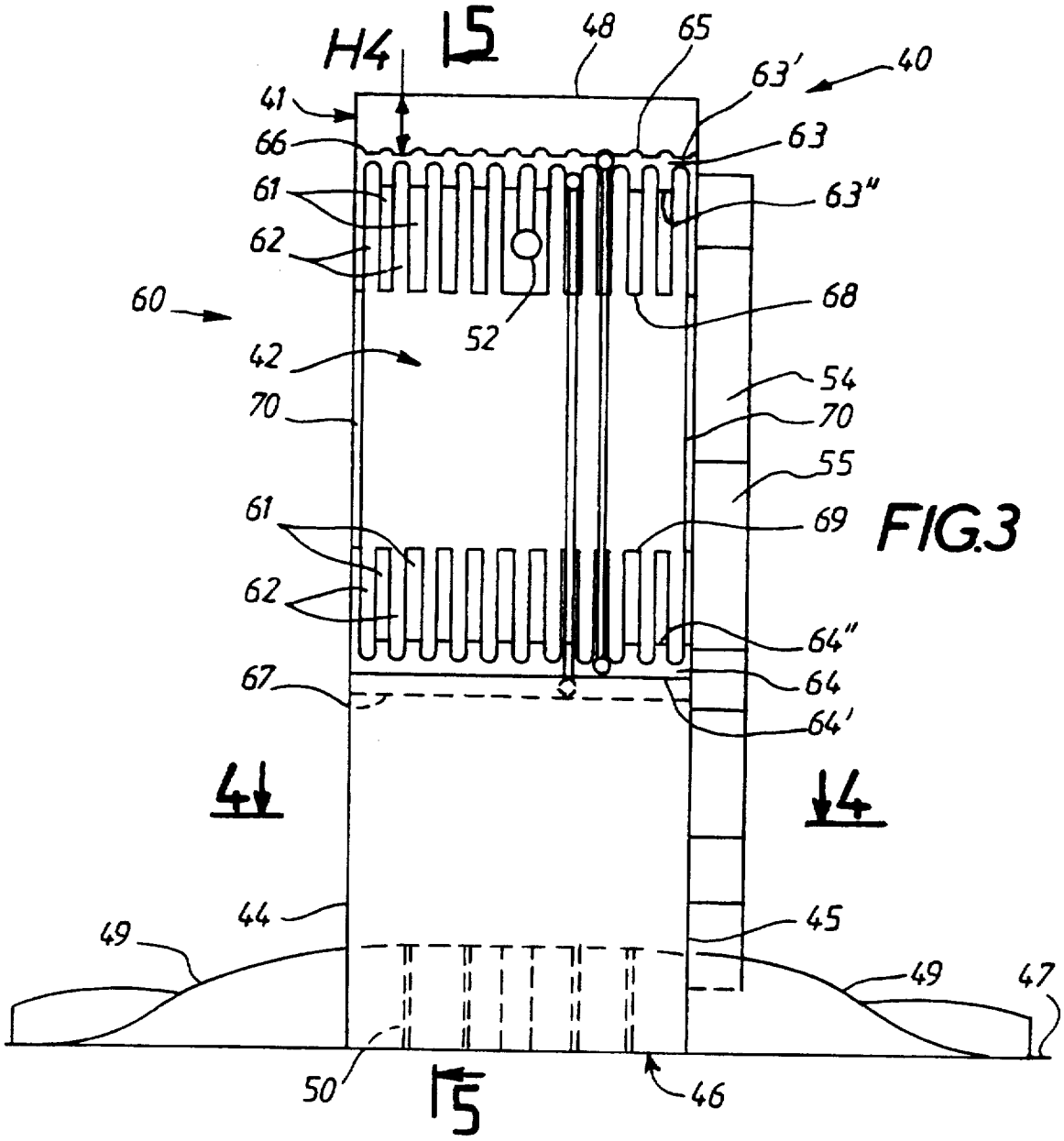
Figure 4:
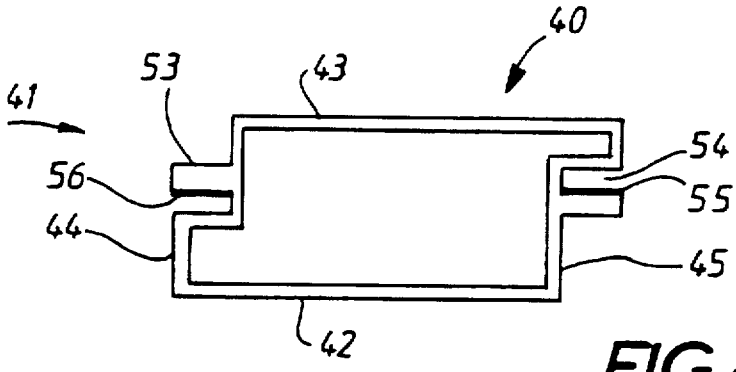
Figure 5:
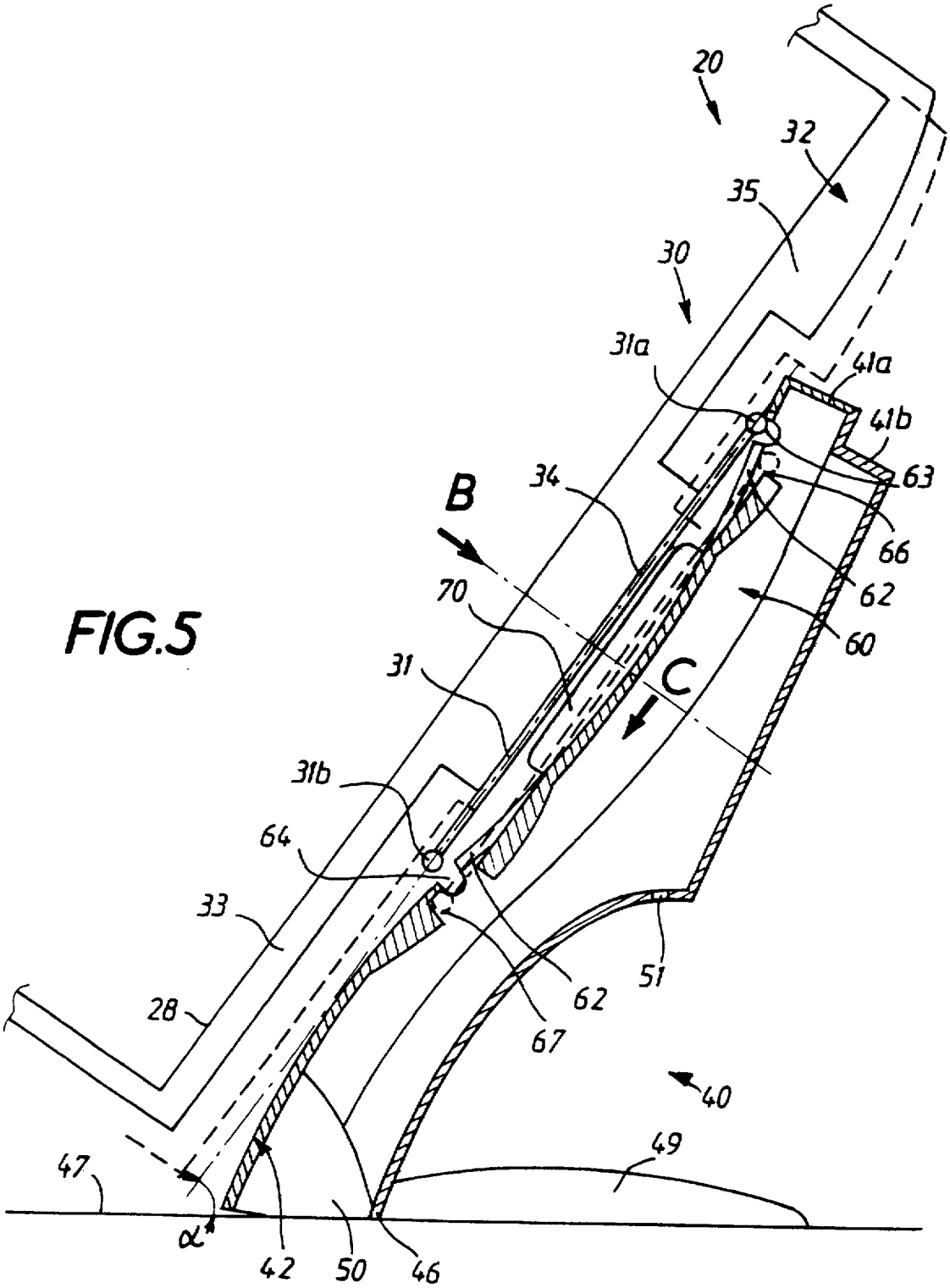
Figure 4A:
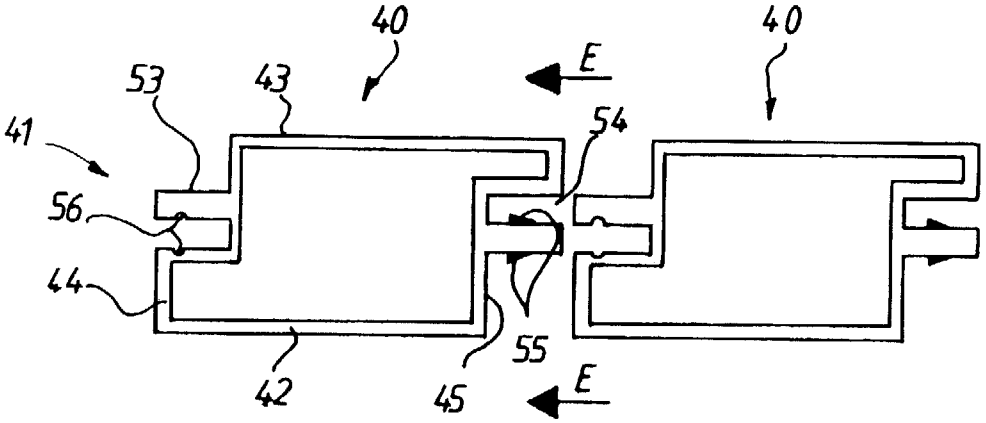

The present invention and its advantages shall be more fully disclosed in the following description of examples of embodiment, with reference to the the attached drawings, in which:

FIG. 1 is a plan view of a transparent envelope designed to contain a document, FIG. 2 is an enlarged cutaway view along the line 2—2 in FIG. 1, FIG. 3 illustrates a front elevation of the display stand's holder according to the invention, FIG. 4 is a partial cutaway drawing along the line 4—4 in FIG. 3, FIG. 4A shows interconnection of two holders together with one another via the complementary snap-on means, FIG. 5 is a side-face cutaway view of the display stand according to the invention along the line 5—5 in FIG. 3, FIGS. 6*a* to 6*d* illustrate other examples of embodiment of a transparent pocket according to the invention.

With reference to FIGS. 1 to 5, the display stand according to the invention has a plurality of transparent pockets 20, designed to hold documents containing information and at least one holder 40 designed to receive said pockets 20 by means of a movable and pivoting link so that the pockets 20 can be turned like the pages of a book.

The transparent pocket 20, as illustrated by FIGS. 1 and 2, comprises an envelope 21 made up in a well known manner of two rectangular sheets 22, 23 in flexible synthetic material, superposed and welded together. The height of the sheet 23 at the back of the envelope is lower than that 22 at the front to leave an opening 24 in which a document 25 can be inserted. The whole periphery of this pocket is made rigid by a metal wire 26 or similar, covered with a protective profile 27 in flexible synthetic material placed around said wire and welded on the four sides of the envelope 21. On one of the lateral faces 28 of the pocket a connecting member 30 is provided to couple this pocket 20 in a movable manner to the holder which shall be described later on. This connecting member 30 is made of a semi-rigid or rigid synthetic material, for example according to an injection process. It comprises a rod 31 which serves as a pivot and a guiding device 32, these elements being connected by a holding strip 33. The holding strip 33 extends along the side 28 of the pocket 20 and is fixed rigidly to it by means of one or two lips 33' which can be on one or two sides of the protective strip 27. The rod 31 is borne by the middle part of this strip 33 at a height of H1. It is placed horizontally at the side 28 of the pocket, at a distance of D1 from it and defines a pivot axis 34. It has two free ends of greater thickness forming indexing heads 31*a*, 31*b*. Above and-below its middle, the holding strip 33 runs along the side 28 of the pocket 20 and has a thickness D2 smaller than D1. In its top part, it has the guiding device 32 at the end with a beak the width of which D3 is at least equal to D1, this beak 35 being at a distance H3 from the upper end 31*a* of the rod 31. This guiding device makes it possible to see which direction the pocket 20 is pointing in and to avoid inserting it upside-down in the holder 40.

The holder 40, as illustrated by FIGS. 3 to 5, comprises a box-shaped frame, provided with a front face 42 with means 60 for receiving said transparent pockets 20, a rear face 43, two lateral faces 44 and 45, a lower face 46, designed to be placed on a horizontal bearing surface 47, and an upper face 48. The lower face 46 forms an acute angle $\alpha$ with the front face 42 so that the latter is positioned in a plane inclined backwards in relation to said bearing surface 47. The frame 41 is stabilized on this bearing surface 47 by two lateral supports 49 inserted into notches 50 provided at the base of the frame 41. Other adequate connections can also be envisaged. These supports 49 are movable so that the same holder 40 can be used in the desk version, according to FIGS. 3 to 5, when they are mounted, and in the wall-mounted version when they are removed. The rear face 43 of the frame 41 has wall fastening means, made up of a slot 51 designed to cooperate with a holding plate (not shown) fixed to the wall, or drilled holes 52 to receive at least one fastening screw (not shown), or possibly other appropriate means. On its lateral faces 44, 45, the frame also has elements making it possible to couple several holders 40 together in a movable manner and thus increase the number of pockets 20 available on one same holder. FIG. 4A shows a second holder 40 to can be coupled to a first holder 40, via the mating complementary means, by movement in the direction of arrow E. These elements have complementary male 53 and female 54 shapes to be fitted together. The complementary female shape 54 can be provided with interlocking elements ("clipping") 55 designed to cooperate with corresponding recesses 56 in the complementary male shape 53, so that the holders are rigidly connected to each other and avoid unintentional disassembly. Other suitable coupling means can be used. The frame 41 is preferably made up of two moulded parts 41*a*, 41*b* in synthetic material, assembled by being fitted together, which makes it possible to simplify manufacture and considerably reduce manufacturing costs. It can also be made of any other suitable material. The front face 42 of the frame 41 has in its top part receiving means 60 comprising:

- a precise number of positioning grooves 61 parallel to one another and to the pivot axis 34, designed to receive the pivot rods 31 of an equivalent number of pockets 20,
- front insertion openings 63, 64 making it possible to insert the indexing heads 31*a*, 31*b*, of rod 31 in the recesses 66, 67 by a movement B perpendicular to the pivot axis 34, and
- recesses 66, 67 in which said indexing heads are inserted by an axial movement C parallel to the pivot axis 34 according to movement B.

The grooves 61 are delimited laterally by guide elements 62, parallel to one another and situated in front of the recesses 66, 67. The guide elements 62 are laid in two distinct rows, one above and the other below, delimited by two edges 68 and 69, these guide elements being matching from one row to the other. They are made by moulding a single piece with said front face 42 and can be salient or recessed in relation to this surface. They can also be weld mounted and take another appropriate shape. The upper 63 and lower 64 front insertion openings extend from said grooves 61 and are designed to let the pockets' 20 rod's 31 indexing heads pass through. The upper insertion openings 63 have a slot in the front face 42 over its whole width and over a height at least equal to twice the diameter of an indexing head, this slot being defined by two edges 63' and 63". These same upper insertion openings 63 are defined laterally by the free ends of the corresponding guide elements 62. To facilitate the insertion of the upper indexing heads 31*a* in these openings 63, the edge 63' is provided with notches 65 in the shape of a semi-circle located opposite said grooves 61. At the rear of these openings 63 is a relief which defines a recess 66 serving as a stop for an upper indexing head 31*a*.

The lower insertion openings 64 are designed according to the same principle as the upper insertion openings 63, particularly in the shape of a slot extending from the front face over its whole width and over a height at least equal to the diameter of an indexing head, this slot being defined by edges 64' and 64". At the rear of these openings 64 is a relief which defines a recess 67 serving as a stop for a lower indexing head 31*b*. The distance H4 separating the edge 63' from the upper surface 48 of the frame 41 is less than or equal to the distance H3 separating the beak 35 of the guiding device 32 from the upper end 31*a* of the rod 31. In this way, the beak 35 remains on the outside the holder 40 and does not interfere with the rotation of the pockets 20. The lateral faces 44, 45 of the frame 41 are extended forwards by a prominent element 70 defining lateral stops making it possible to hold the pockets 20 laterally and thus limit their pivoting angle.

The holder such as described above can receive several formats of pockets as the shape and size of the connecting members 30 incorporated into the pockets 20 can remain identical from one format to another.

To put a transparent pocket 20 in place on a holder 40, as illustrated by FIG. 5 in continuous dashes, simply hold it with one hand and bring it closer along arrow B perpendicular to the front face 42 of the holder, the guiding device 32 pointing upwards, insert the rod 31 in one of the positioning grooves 61 until it rests at the bottom of this groove, and the two indexing heads 31*a*, 31*b* in the corresponding insertion openings 63, 64. When the pocket 20 is released, it slides downwards by gravity along arrow C to the position illustrated by FIG. 5 in dotted lines, the rod 31 being guided in its corresponding groove 61, until it positions its indexing heads 31*a*, 31*b* in the recesses 66, 67 provided. In this position, the pocket 20 can pivot to the right and to the left without any risk of it coming out of its holder. To remove it again, seize it with one hand, place it perpendicular to the holder, slide it upwards in the opposite direction to arrow C, until the indexing heads 31*a*, 31*b* are freed from their recess 66, 67 and placed in their respective insertion opening 63, 64, then remove the pocket in the opposite direction to arrow B. If the pocket is held upside-down when it is inserted in the holder, as the beak 35 of the guiding device is pointing downwards it will bump against the front face 42 of the frame below the receiving means 60 and thus prevent this pocket from being put in place. If the pocket is presented the right way up, the distance H3 is sufficient for the beak 35 to always remain above the upper surface of the frame 41, as FIG. 5 shows, and thus neither prevents the pocket 20 from being put in place or pivoting on the holder 40.

Figure 6C:
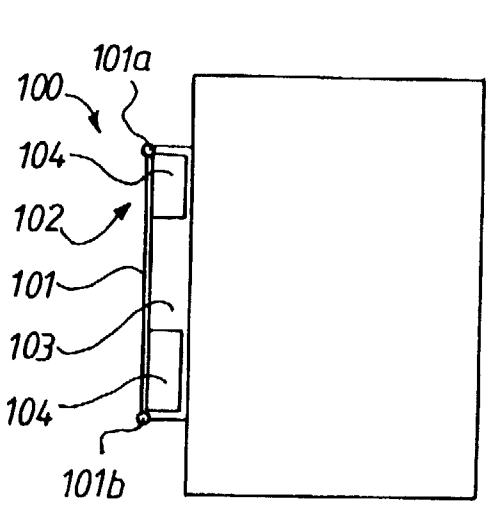
Figure 6B:
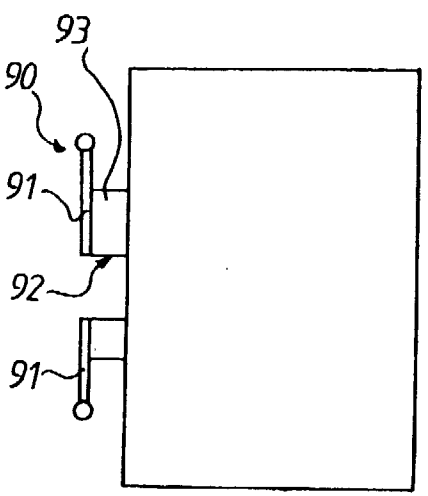
Figure 6A:
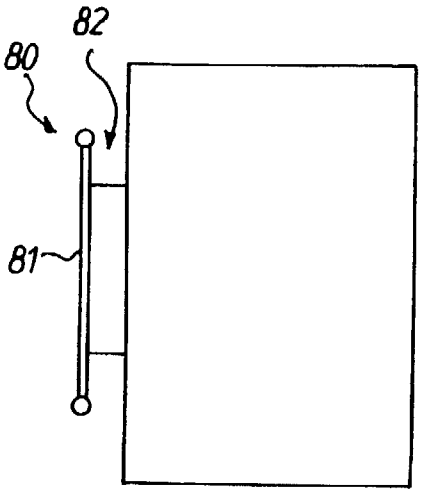

There are of course numerous other forms of embodiment of the connecting member incorporated into the pocket and which can cooperate with the receiving means 60 integrated into the holder, whilst retaining the inventions' characteristics. FIGS. 6*a* to 6*c* illustrate some examples of other embodiments of the connecting member. In FIG. 6*a*, the connecting member 80 is similar to the one described previously, its guiding device 82 being made up of the pivoting rod 81 itself, the top part of which is longer than the bottom part. In FIG. 6*b*, the connecting member 90 has a pivoting rod and is split into a top part and a bottom part, the guiding device 92 being made up of the holding strip 93 the height of which is different in these two parts. In FIG. 6*c*, the connecting member 100 has a pivoting rod 101 the ends of which 101*a* and 101*b* are connected to the holding strip 103 which has two pivoting holes 104. The guiding device 102 is obtained by a dissymetry of these two holes.

The invention is not restricted to the examples of embodiment described but can be extended to include any modification or variation which is obvious for the expert.

I claim:

1. A document display stand comprising at least one pocket (20) which is provided with a transparent envelope (21) for containing a document (25), a holder (40) for supporting said at least one pocket (20) and a movable connecting device for pivotally affixing each of said at least one pocket (20) to said holder (40);

said connecting device having a connecting member (30) located along a side edge (28) of each said at least one pocket (20), and receiving means (60) being located on a front face (42) of said holder (40) for receiving and supporting said connecting member of said connecting device in a pivotable manner, each said connecting member having a pivot rod (31) which defines a pivot axis (34) such that said pivot axis extends parallel to said side edge (28) of said at least one pocket and said pivot rod (31) being spaced a distance (D1) from said envelope (21), said receiving means (60) comprising at least one row of recesses (66, 67) in which said pivot rod is inserted by an axial movement (C) parallel to said pivot axis (34);

each said connecting member (30) having a holding strip (33) located between said pivot rod (31) and said envelope (21), and said receiving means (60) having at least one groove (61) for receiving said pivot rod (31) of said connecting member (30);

wherein said connecting device has a guiding device (32) which prevents said at least one pocket (20) from being mounted on said holder (40) in an upside-down manner, said guiding device (32) includes a beak (35) provided on said connecting member (30) of each said connecting device, and said beak (35) adapted to abut against said front face (42) of said holder (40) to prevent each of said at least one pocket (20) from being inserted in said receiving means (60) when attempting to affix said at least one pocket (20) to said holder (40) in an upside-down manner but allows pivoting motion of said at least one pocket (20) with respect to said holder (40) when said at least one pocket (20) is properly affixed to said holder (40) in a right-side up manner.

2. The display stand according to claim 1, wherein said receiving means (60) has, adjacent said recesses (66, 67), at least one front opening (63, 64) which facilitates insertion of said pivoting rod in said recesses by a first movement (B) perpendicular to said pivot axis (34) followed by said axial movement (C).

3. The display stand according to claim 2, wherein each of said pivot rods has at least one protruding free end which is thicker, relative to a middle portion of said pivot rod, to form at least one indexing head (31*a*, 31*b*).

4. The display stand according to claim 3, wherein said at least one front opening (63, 64) has a width that is greater than a width of said at least one groove (61) to allow each of said at least one indexing head (31*a*, 31*b*) of said pivot rod to pass therethrough during said perpendicular movement (B).

5. The display stand according to claim 4, wherein each of said at least one groove (61) are delimited laterally by guide elements (62) which extend in front of said recesses (66, 67) to receive said at least one indexing head (31*a*, 31*b*).

6. The display stand according to claim 1, wherein said guiding device is formed from dissymmetrical holding strips (33) such that a first half of said dissymmetrical holding strip (33) is not symmetrical with respect to a second half of said dissymmetrical holding strip (33).

7. The display stand according to claim 6, wherein said guiding device (32) comprises said beak (35) provided on said holding strip (33).

8. The display stand according to claim 1, wherein said front face (42) of said holder (40) has at least one lateral pair of prominent stops (70), incorporated into said holder, for limiting pivoting of said at least one pocket (20).

9. The display stand according to claim 1, wherein said holder (40) has two lateral faces (44, 45) and has a male coupling means (53) provided on one of said two lateral faces (44) and a complementary female coupling means (54) provided on said other of said two lateral faces (45), and said coupling means (53, 54) have interconnectable snap-on means (55, 56) for interconnecting two of said holders together with one another.

10. A document display stand comprising at least one row of pockets (20), each of said pockets have a transparent envelope (21) for containing a document (25), a holder (40) having a front face (42), said holder (40) being designed to support said pockets (20) and each of said pockets (20) having a movable connecting device;

said connecting devices each having a connecting member (30) located along one side (28) of each of said pockets (20), and said front face (42) of said holder (40) having receiving means (60) designed to support each of said connecting members (30) of said at least one row of pockets (20) in a pivoting and movable manner, each of said connecting members (30) having a projection comprising a pivot rod (31) which defines a pivot axis (34) extending parallel to the one side (28) of each of said pockets (20) and each of said pivot rods (31) being located at a distance (D1) from each of said corresponding envelopes (21) of said corresponding pockets (20), said receiving means (60) comprising at least one row of recesses (66, 67) in which said pivot rods are inserted by means of an axial movement (C) parallel to said pivot axis (34);

said connecting members (30) each having a holding strip (33) located between said corresponding pivot rod (31) and said corresponding envelope (21), and said receiving means (60) having grooves (61) each of said grooves (61) designed to receive a corresponding one of said pivot rods (31) of each of said pockets (20);

said connecting devices each have a guiding device (32) comprising a beak (35) designed to abut against said front face (42) to prevent each of said pivot rods (31) from being inserted in said receiving means (60) in an upside-down orientation but allows pivoting motion of said pockets (20) with respect to said holder (40) when said pockets (20) are properly affixed to said holder (40) in a right-side up manner, said holder (40) has two lateral faces (44, 45) and has a male part coupling means (53) provided on one of said two lateral faces (44) and a complementary female part coupling means (54) provided on said other of said two lateral faces (45), and said male and female coupling means (53, 54) have interconnectable snap-on means (55, 56) for interconnecting two of said holders together with one another.

11. A document display stand comprising at least one row of pockets (20), each of said pockets have a transparent envelope (21) for containing a document (25), a holder (40) having a front face (42), said holder (40) being designed to support said pockets (20) and each of said pockets (20) having a movable connecting device;

said connecting devices each having a connecting member (30) located along one side (28) of each of said pockets (20), and said front face (42) of said holder (40) having receiving means (60) designed to support each of said connecting members (30) of said at least one row of pockets (20) in a pivoting and movable manner, each of said connecting members (30) having a projection comprising a pivot rod (31) which defines a pivot axis (34) extending parallel to the one side (28) of each of said pockets (20) and each of said pivot rods (31) being located at a distance (D1) from each of said corresponding envelopes (21) of said corresponding pockets (20), said receiving means (60) comprising at least one row of recesses (66, 67) in which said pivot rods are inserted by means of an axial movement (C) parallel to said pivot axis (34);

said connecting members (30) each having a holding strip (33) located between said corresponding pivot rod (31) and said corresponding envelope (21), and said receiving means (60) having grooves (61) each of said grooves (61) designed to receive a corresponding one of said pivot rods (31) of each of said pockets (20);

said connecting devices each have a guiding device (32) comprising a beak (35) designed to abut against said front face (42) to prevent each of said pivot rods (31) from being inserted in said receiving means (60) in an upside-down orientation but allows pivoting motion of said pockets (20) with respect to said holder (40) when said pockets (20) are properly affixed to said holder (40) in a right-side up manner; and each of said pivot rods (31) has at least one protruding free end which is thicker, relative to a middle portion of said corresponding pivot rod, to form at least one indexing head (31*a*, 3*b*), said receiving means (60) has at least one insertion opening (63, 64) which extends from a corresponding one of each of said at least one groove (61), and said at least one insertion opening has a width that is greater than a width of said at least one groove to allow each of said at least one indexing head (31*a*, 31*b*) of said pivot rods to pass therethrough during perpendicular movement (B) of each of said pivot rods relative to said pivot axis (34).

12. The display stand according to claim 11, wherein each of said at least one groove (61) are delimited laterally by guide elements (62) which extend in front of said recesses (66, 67) to receive said at least one indexing head (31*a*, 31*b*).

* * * * *